United States Patent [19]

Fletcher et al.

[11] 4,396,471

[45] Aug. 2, 1983

[54] GOLD PLATING BATH AND METHOD USING MALEIC ANHYDRIDE POLYMER CHELATE

[75] Inventors: Augustus Fletcher, Bristol; William L. Moriarty, South Meriden, both of Conn.

[73] Assignee: American Chemical & Refining Company, Inc., Waterbury, Conn.

[21] Appl. No.: 330,706

[22] Filed: Dec. 14, 1981

[51] Int. Cl.[3] ..... C25D 3/48; C25D 3/62

[52] U.S. Cl. ..... 204/43 G; 204/46 G; 525/327.8; 525/371; 260/429 J

[58] Field of Search ..... 204/43 G, 46 G; 525/327.8, 371; 260/439 R, 429 J

[56] References Cited

U.S. PATENT DOCUMENTS

| | | | |
|---|---|---|---|
| 2,047,398 | 7/1936 | Voss | 260/45.5 |
| 2,752,281 | 6/1956 | Niederhauser | 167/17 |
| 2,812,299 | 11/1957 | Pforzheim | 204/43 |
| 2,905,601 | 9/1959 | Rinker et al. | 204/43 |
| 3,087,853 | 4/1963 | Hosmer et al. | 167/17 |
| 3,149,057 | 9/1964 | Parker et al. | 204/46 |
| 3,149,058 | 9/1964 | Parker et al. | 204/46 |
| 3,271,310 | 9/1966 | Le Suer | 260/439 R |
| 3,407,126 | 8/1968 | Koretsky | 204/43 N |
| 3,424,597 | 1/1969 | Shipley | 106/1.26 |
| 3,432,445 | 3/1969 | Osgan et al. | 260/439 R |
| 3,672,969 | 6/1972 | Nobel et al. | 204/43 |
| 3,706,634 | 12/1972 | Kowalski | 204/46 |
| 3,716,463 | 2/1973 | Bick et al. | 204/43 |
| 3,770,596 | 11/1972 | Bick et al. | 204/43 G |
| 3,787,463 | 1/1974 | Zuntini et al. | 260/430 |
| 3,856,638 | 12/1974 | Bick et al. | 204/43 G |
| 3,864,222 | 2/1975 | Wilson et al. | 204/43 G |
| 3,902,977 | 9/1975 | Greenspan | 204/43 G |
| 4,186,064 | 1/1980 | Morrissey | 204/43 G |
| 4,197,172 | 4/1980 | Fletcher et al. | 204/43 G |
| 4,253,920 | 3/1981 | Fletcher et al. | 204/43 G |

OTHER PUBLICATIONS

GAF Technical Bulletin No. 7543-017, "Gantrez AN:-Poly(methyl vinyl ether/maleic anhydride)".

*Primary Examiner*—Thomas A. Waltz
*Assistant Examiner*—Gerard Rooney

[57] ABSTRACT

An all-purpose gold cyanide electroplating bath utilizes a cobalt, nickel, or indium hardener as a chelate with the acid form of a methyl vinyl ether/maleic anhydride interpolymer. The bath is capable of producing high levels of hardness in deposits that are substantially pure gold; it is efficient, very stable, resistent to contamination, and it is well-suited for utility at a wide range of current densities.

11 Claims, No Drawings

GOLD PLATING BATH AND METHOD USING MALEIC ANHYDRIDE POLYMER CHELATE

BACKGROUND OF THE INVENTION

Metals, such as cobalt, nickel, and indium are often added to gold plating compositions to increase the hardness of the electrodeposited metal. Provided that the composition of such a bath and the conditions under which it is operated are adequately controlled, bright deposits are readily obtained over a wide range of current densities. The prior art has long recognized the desirability of incorporating such metals into gold plating formulations, exemplary of which are the following U.S. Pat. Nos.: 2,812,299; 3,149,057; 3,149,058; 3,716,463; 3,787,463; 3,856,638; 3,864,222; 3,902,977; 2,905,601; 4,076,598; 4,186,064; 4,197,172; and 4,253,920 (the latter two patents being in the names of applicants, and of common assignment herewith).

While a variety of compounds may be utilized as the means by which the hardening agents are introduced into the plating bath, it has been recognized that considerable advantage can be realized by the utilization of chelated forms of the metals. Thus, U.S. Pat. No. 3,149,057 discloses the addition of the cobalt chelate of ethylenediamine tetraacetic acid; U.S. Pat. No. 3,149,058 teaches the use of the nickel chelate of an amino polycarboxylic acid; U.S. Pat. No. 3,787,463 discloses the use of polyamine sulfite complexes of the metal ions; U.S. Pat. No. 3,856,638 teaches the utilization of cobalt in the form of a complex with amino guanidine; U.S. Pat. No. 3,864,222 teaches the inclusion of compounds or chelates, such as cobalt or nickel sulfates or chelates of base metals with nitrilotriacetic acid or ethylenediamine tetraacetic acid, and the like; U.S. Pat. No. 4,186,064 employs a preformed, fully neutralized salt of a cobalt or nickel organophosphorus chelate; and U.S. Pat. No. 4,253,920 discloses the inclusion of the chelated forms of nickel or cobalt with 1-hydroxyethylidene-1,1-diphosphonic acid.

Generally, in electroplating baths for gold and other metals there is a tendency for contamination with extraneous metals to occur, which can affect the stability of the bath and cause a rapid decrease in the current efficiency at which it operates. In response, phosphonic acid chelating agents have, for example, been proposed for use in such baths, for the purpose of complexing with contaminants such as copper and lead, to thereby reduce or eliminate their deleterious effects. Exemplary of the baths containing such agents are those that are described in U.S. Pat. Nos. 3,770,596; 3,672,969; 3,706,634; and 3,904,493. The use of various organic compounds as brighteners, levelling agents, buffering agents, and the like has, of course, long been known, and the patent and technical literature proposes many compounds and combinations thereof to achieve various effects and advantages. Despite the foregoing, there remains a demand for an all-purpose bath which is stable and resistent to contamination, and which is capable of operating efficiently at high speeds and over a wide range of current densities, to produce hard bright deposits of substantially pure gold.

Accordingly, it is an object of the present invention to provide a novel gold plating bath containing a cobalt, nickel, and/or indium hardener, which is stable and efficient over wide ranges of current density, pH values and temperatures, and which can be used to excellent advantage for rack, barrel, strip and other high speed applications.

It is also an object of the invention to provide such a bath from which hard gold deposits are produced, which deposits contain a very small amount of the codeposited metal, relative to the high level of hardness achieved.

Another object of the invention is to provide such a bath which can be formulated readily and relatively economically, and which is highly resistant to the effects of metal contamination.

Yet another object of the invention is to provide a novel and highly efficient method for electrodepositing hard, bright gold deposits over wide ranges of current densities, pH values and temperatures, which is well-suited for use in a variety of electroplating techniques and apparatus.

SUMMARY OF THE INVENTION

It has now been found that certain of the foregoing and related objects of the invention are readily attained in a gold plating bath comprising, on a per liter basis, an aqueous solution of the following ingredients: an alkali metal gold cyanide in an amount providing about 1 to 41 grams of gold, calculated as the metal; free alkali metal cyanide in an amount effective to prevent precipitation of the metal values; an effective amount of an electrolyte; and about 0.05 to 10.0 grams of cobalt, nickel, indium, or a mixture thereof. The latter is provided in the form of a chelate with a constituent hydrolyzed interpolymer of a methyl or ethyl vinyl ether and maleic anhydride, and the bath has a pH value of about 3 to 13.

In the preferred embodiments of the bath, the dissolved electrolyte will comprise a weak organic acid, and most desirably citric acid. In some instances, it may be advantageous to utilize an inorganic acid to provide a portion of the electrolyte, such as will produce the phosphate, nitrate or sulfate radical in the solution. The bath will generally additionally include an alkali metal hydroxide for pH adjustment, and most commonly both the hydroxide and also the alkali metal and gold cyanides will be compounds of potassium. The most preferred baths will have an acid pH, most desirably in the range 4 to 6, and a specific gravity of about 4° to 30° Baume, and the interpolymer, from which the chelate is made, will be a poly(methyl vinyl ether/maleic anhydride) resin. The chelate will generally be present in the bath in such an amount that the maximum concentration of the hardener metal will be about 4.0 grams per liter, and most desirably it will furnish about 0.2 to 1.5 grams per liter thereof; baths used for industrial gold plating will usually contain about 0.2 to 0.3 gram per liter of the hardener (in chelated form), and decorative plating baths will normally contain about 0.5 to 1.5 grams per liter thereof.

Other objects of the invention are attained in a method of electroplating hard gold deposits upon a workpiece comprising, as an initial step, immersing a workpiece having an electrically conductive surface in a gold plating bath, formulated as hereinabove set forth. The temperature of the bath is maintained at a value between about 20° and 75° Centigrade, and an electrical potential is applied across the workpiece and an anode to provide a current density of about 0.1 to 165 amperes per square decimeter (ASD) at the workpiece. Electrodeposition of gold in the desired thickness is thereby effected, after which the electroplated workpiece is withdrawn from the bath.

The preferred temperature range at which the plating operations will be carried out is about 35° to 50° Centigrade, with temperatures at the lower end of the range being most desirable when the bath is utilized to produce deposits for decorative applications, and with values at the upper end of the range being most suitable when the bath is utilized to produce industrial grade electroplate. In the former instance, a current density below about 5.0 amperes per square decimeter will be most desirable, whereas current densities as high as 75 amperes per square decimeter will usually be used in the latter case. Agitation of the bath and/or the workpiece will generally produce the best results, and the current density at which optimal deposits are produced will normally depend, at least to some degree, upon the type of cell agitation employed.

DETAILED DESCRIPTION OF THE PREFERRED EMBODIMENTS

As will be appreciated by those skilled in the art, the outstanding results achieved using the bath and the method of the present invention are largely attributable to the unique metal chelate employed, and described herein. Although the interpolymer utilized to produce the chelate is itself old in the art and is commercially available, so far as is known metal chelates thereof have not heretofore been disclosed or produced, and there has not previously been any suggestion that the use of such a complex of cobalt, nickel, or indium, in a gold electroplating bath, would produce the highly desirable results and unique advantages discovered by applicants.

It is believed that the maleic anhydride interpolymer was itself first described in Voss et al U.S. Pat. No. 2,047,398 (reissued as U.S. Pat. No. Re. 23,514), which issued originally on July 14, 1936. It is indicated therein that such resins are capable of forming salts of alkalies, alkaline earths and the like, and that they may be alkylated or amidated, or caused to react with other organic species. The patentees teach that the copolymers are suitable for use in a variety of industrial applications, specifically suggesting use in the manufacture of lacquers, impregnating materials, electrical insulating materials, adhesives, and formed articles; they are also disclosed to be useful as assistants in the textile and like industries. There is, however, no suggestion that metal derivatives of the interpolymers might be produced, or that the resins themselves would have any utility in electroplating formulations.

In U.S. Pat. No. 2,752,281, Niederhauser effects reaction between iodine and the copolymer of methyl vinyl ether and maleic anhydride, to produce a germicidal solution. Similarly, in U.S. Pat. No. 3,087,853, Hosmer et al disclose a composition comprised of iodine associated with, or complexed into, any of various water soluble polymeric substances, preferably the maleic anhydride-vinyl copolymer of the above-identified Voss patent; in a specific example, the methyl vinyl ether copolymer is employed.

In the practice of the present invention, the methyl vinyl ether/maleic anhydride chelate has been found to afford optimal results, from the standpoint of providing a highly efficient, all-purpose bath capable of producing bright, hard deposits of gold of virtually twenty-four carat purity. However, it is believed that homologous copolymers may also be suitable for use, most notably the ethyl vinyl derivative. In any event, it is understood that these are true copolymers (i.e., interpolymers), characterized by a highly homogeneous distribution of the monomer units, and that the latter are present therein in substantially equimolar amounts. The molecular weight of the polymerized material may, of course, vary, and it is not critical to the present invention that a product of any particular value be utilized, as long as the material has adequate solubility in the bath under the desired conditions of operation, and is not unduly viscous. Excessive viscosity would, for example, tend to increase drag-out from the bath, which would of course be undesirable for obvious reasons. The interpolymer utilized to produce the chelate is commercially available from GAF Corporation of New York, New York under the trademark GANTREZ, which designates a family of water-soluble linear polyelectrolyte resins. They are available in several molecular weight ranges: i.e., GANTREZ AN-119 is a low molecular weight grade of the resin, GANTREZ AN-139 and AN-149 are medium molecular weight grades, and GANTREZ AN-169 is a relatively high molecular weight product. Hydrolyzed forms of such resins are also commercially available from the GAF Corporation under the names GANTREZ S-95 and GANTREZ S-97, which products differ from one another essentially in the viscosities that they exhibit in aqueous solution, the former having the lower viscosity. All of the foregoing GANTREZ products are suitable for use in the production of the metal chelates utilized in the present baths, hydrolysis of the "AN" resins to the acid form being effected prior to reaction with the metal ion; the reaction between the metal ion and the hydrolyzed polymer, to produce the metal chelate, is believed to proceed as follows:

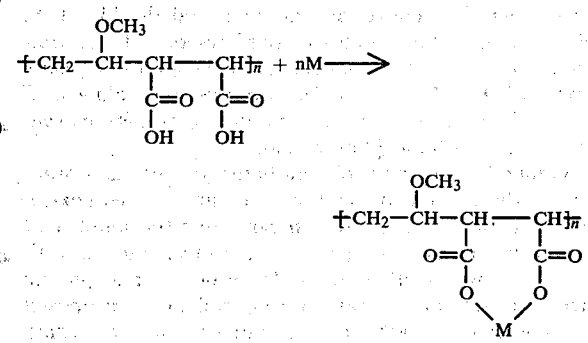

wherein "n" designates the number of repeating monomeric units in the interpolymer, and the corresponding number of metal atoms complexed therewith, and "M" is cobalt, nickel, and/or indium.

Although other reaction schemes may occur to those skilled in the art, one suitable method for the production of the cobalt chelate involves adding 5.0 grams of GANTREZ S-95 to 75 milliliters of distilled, deonized water, and heating the mixture to 65.5° Centigrade. One gram of cobalt carbonate (or other soluble salt thereof) is slowly added to the warm solution, with stirring, until reaction between the salt and the interpolymer is complete, as evidenced by the cessation of gasing. Sufficient additional deonized water is then added to provide 100 milliliters of the solution, after which it is cooled to room temperature; the resultant reagent is clear red and contains 5.0 grams per liter of cobalt, determined as the metal (this material will be referred to hereinafter as "cobalt chelate A").

As an alternative, a 10.0 gram per liter solution of cobalt (hereinafter referred to as "cobalt chelate B") can be produced by admixing 15 grams of the GANTREZ S-95 resin with 200 milliliters of water, with 5 grams of cobalt carbonate being added (with stirring) after the mixture is brought to temperature, as above. Gasing ceases after about one hour's time, following which the volume is increased to 250 milliliters with additional deonized water, and the solution is cooled to room temperature for use. The foregoing procedure can also be utilized to produce the nickel chelate by substituting its carbonate salt for the cobalt compound; in that instance, however, the solution exhibits a clear green (rather than red) coloration.

While a relatively high concentration of the metal chelate will be desirable in certain instances to provide maximum hardness in the deposit and optimal operating conditions, an amount that furnishes 10 grams per liter of the metal appears to represent a practical upper limit. A high concentration of the alloying metal will, of course, be undesirable in those instances in which a high purity gold deposit is to be produced, and it will generally be preferred to utilize such an amount of the chelate as will provide a concentration of about 0.05 to 4.0 grams per liter of the metal in the bath, depending to a large extent upon the applications for which the bath is intended. Thus, as noted above, in a bath intended for decorative plating the most desirable concentration of the codepositable metal will be about 0.5 to 1.5 grams per liter, whereas for industrial applications the bath will most desirably contain about 0.2 to 0.3 gram per liter thereof. In any event, it is to be noted that a unique feature of the present baths concerns their ability to produce high levels of hardness despite the presence of surprising small amounts of the hardening metal in the deposit; this will be disussed further with reference to the Examples that follow. It might be noted that the presence of a significant amount of the free maleic anhydride interpolymer in the bath will generally be undesirable, in that it tends to decrease current efficiency.

Although the alkali metal gold cyanide may provide as little as one, or as much 41, grams per liter of gold, the preferred compositions contain about 2.5 to 15 grams per liter thereof. It will generally be desirable to add free alkali metal cyanide for bath stability, since the various metals apparently complete for the complexing cyanide ions, and thereby cause precipitation of the essential metals if the cyanide concentration is too low. To be effective, the amount of free alkali metal cyanide present will usually be at least 0.05, and preferably at least 0.25, gram per liter; on the other hand, and depending upon the pH of the bath, there will be a tendency for evolution of hydrogen cyanide gas if the concentration of free cyanide is too high, and about 3.75 grams per liter therefore will represent a practical upper limit in most cases. It might be mentioned that any free alkali metal cyanide added is desirably introduced into the gold cyanide solution before its admixture with the remaining components, again from the standpoint of ensuring optimal bath stability.

The amounts of the electrolyte ingredients employed can vary widely, and typically the primary conductive ingredients will be added in concentrations of about 15 to 250 grams per liter, although usually the amount employed will not exceed 180 grams per liter. As mentioned above, the composition of the electrolyte is not critical, although the inclusion of a substantial amount of a weak organic acid, such as malic, formic, succinic, boric, and especially citric, will generally produce the best results. This is true, moreover, regardless of whether or not the electrolyte contains an inorganic acid radical, such as phosphate, sulfate, nitrate and the like. As will be appreciated, virtually any conductive acid or salt can be utilized, as long as interfering ions are not introduced thereby, and usually it will be desirable to include a salt and an acid (e.g., potassium citrate and citric acid) to buffer the bath at a suitable pH value.

Operating conditions may vary fairly widely, rendering the baths of the invention well suited for use by virtually any technique by which gold is commonly electroplated. Temperatures of 20° to 75° Centigrade are typical, although values of 35° to 50° Centrigrade will generally be preferred, depending to some extent upon the nature of the deposit to be produced and the plating method employed. The current density will usually be in the range of 0.1 to 165 amperes per square decimeter, but this will again depend upon the particular manner in which the bath is used. Although the bath may have a pH as high as 13 and still remain stable, the brightness range will be quite limited at values above neutral; consequently, it will preferably be maintained at a pH of about 3.0 to 7.0, and most desirably at about 4.0 to 6.0. The optimal pH will depend upon the plating technique used, the properties desired in the deposit produced, and upon the composition of the bath, the nature of the metal hardener complex being especially important in the latter regard. Finally, the specific gravity of the bath will normally be maintained between 4° and 30° Baume, to ensure adequate conductivity.

As noted, various types of plating apparatus can be employed for carrying the method of the present invention, including barrel and rack plating equipment, high speed continuous selective plating equipment, and the like. Generally, good agitation of the workpiece and/or the bath will produce optimal results, and filtration should be provided for that reason and to avoid operational difficulties. In addition to the conventional direct current plating, pulse plating can be employed to produce good, non-porous deposits at relatively high rates, with the metal constituent concentrations being proportionately reduced, as required.

Various anodes can be employed, including gold, stainless steel, platinum, platinum-clad tantalum and graphite. The material from which the tank or other vessel is fabricated should be inert to the bath, and polypropylene, rubber-lined steel, polyvinylchloride or other suitable materials are desirably used.

Exemplary of the efficacy of the present invention are the following specific examples, wherein all parts are as indicated, and wherein the cobalt and nickel chelates employed are as prepared and designated hereinabove. Hardnesses are expressed as Knoop hardness values, and represent the average of a number of tests using a 25 gram indenting tool.

EXAMPLE ONE

A series of plating baths are prepared and tested in a standard Hull cell, to determine the range of current density through which a bright gold deposit is produced and the efficiency of the bath. The bath compositions (A through H), operating conditions, and results achieved are set forth in Table One, which follows:

TABLE ONE

| | | A | B | C | D | E | F | G | H |
|---|---|---|---|---|---|---|---|---|---|
| Formula | | | | | | | | | |
| Potassium Citrate | g/l | 90.0 | 60.0 | 90.0 | 60.0 | | 90.0 | 60.0 | |
| Citric Acid | g/l | 90.0 | 60.0 | 90.0 | 60.0 | | 90.0 | 60.0 | |
| Mono Potassium Phosphate | g/l | | 60.0 | | 60.0 | 150.00 | | 60.0 | 150.00 |
| Phosphoric Acid | ml/l | | | | | 1.5 | | | |
| Potassium Hydroxide | g/l | 11.48 | 8.2 | 11.48 | 8.2 | | 10.57 | 11.3 | |
| Potassium Gold Cyanide (68%) | g/l | 12.0 | 12.0 | 12.0 | 12.0 | 12.0 | 12.0 | 12.0 | 12.0 |
| Potassium Cyanide | g/l | 0.25 | 0.25 | 0.25 | 0.25 | 0.25 | 0.25 | 0.25 | 0.25 |
| Cobalt Chelate (A) | ml/l | 50.0 | 50.0 | | | | | | |
| Cobalt Chelate (B) | ml/l | | | 50.0 | 50.0 | 25.0 | | | |
| Nickel Chelate | ml/l | | | | | | 25.0 | 25.0 | 25.0 |
| Both Conditions | | | | | | | | | |
| Gold (as metal) | g/l | 8.2 | 8.2 | 8.2 | 8.2 | 8.2 | 8.2 | 8.2 | 8.2 |
| Cobalt/Nickel (as metal) | g/l | 0.250 | 0.250 | 0.500 | 0.500 | 0.250 | 0.250 | 0.250 | 0.250 |
| Density (Baume°) | | 13.4 | 15.2 | 13.4 | 15.2 | 15.0 | 13.0 | 15.5 | 15.0 |
| pH (Electrometric) | | 4.0 | 4.0 | 4.0 | 4.0 | 4.0 | 4.0 | 4.0 | 4.06 |
| Current (Amperes) | | 0.5 | 0.5 | 0.5 | 0.5 | 0.5 | 0.5 | 0.5 | 0.5 |
| Time (minutes) | | 2.0 | 2.0 | 2.0 | 2.0 | 2.0 | 2.0 | 2.0 | 2.0 |
| Temperature (°C.) | | 32.2 | 32.2 | 32.2 | 32.2 | 32.2 | 32.2 | 32.2 | 32.2 |
| Result | | | | | | | | | |
| Bright Range (ASD) | | 0–0.2 | 0–0.2 | 0–0.2+ | 0–0.2+ | 0–0.2+ | 0–0.1 | 0–0.1 | 0–0.2 |
| Efficiency (mg/amp. minute) | 48.2 | 49.8 | 46.9 | 45.7 | 42.4 | 56.1 | 57.5 | 36.0 | |

All baths remain clear and stable, with the exception of formulations E and H, in which relatively small amounts of precipitates (analyzed to be compounds of gold and cobalt, and gold and nickel, respectively) are formed; this suggests the desirability of including a weak organic acid as an ingredient of the electrolyte (compare baths B, D and G), in accordance with the preferred embodiments.

EXAMPLE TWO

Part A

Using the bath designated A in Example One, at a pH of 4.0, a platinized tantalum coupon and two brass coupons are plated at a current density of 0.1 ampere per square decimeter. After stripping the deposit from the tantalum coupon, it is analized and found to be 99.79 percent pure gold, the remainder being 0.19 cobalt, 0.014 copper, 0.005 iron and 0.001 nickel (all in percentages by weight). The deposit on one of the brass coupons is analyzed for hardness and found to have a value of 206, representing the average of five to ten indentations; the deposit on the other brass coupon is analyzed and found to have a density of 16.35 grams per cubic centimeter. Plating with this bath is also carried out in a Hull cell at 0.5 ampere, and found to operate at a current efficiency of 48.3 milligrams per ampere-minute.

Part B

The pH of the bath used in Part A is elevated with potassium hydroxide to a value of 4.4, and the plating procedures are repeated to determine Hull cell efficiency and the hardness of the deposit produced. Efficiency is increased to 66.7 milligrams per ampere-minute, and a hardness value of 199 is obtained.

Part C

The tests of Part A are repeated, utilizing the bath designated F in Example One. The deposit is found to contain (in percentages) 99.95 gold, 0.014 cobalt, 0.002 copper, 0.005 iron, and 0.033 nickel; it has a Knoop hardness value of 170, and a density of 17.32 grams per cubic centimeter. In the Hull cell test, a current efficiency of 54.8 milligrams per ampere-minute is obtained.

The foregoing demonstrate the ability of the baths of the present invention to produce hard deposits, with surprisingly low concentrations of codeposited metal hardener, and to do so at very good levels of current efficiency.

EXAMPLE THREE

Part A

One gallon of a plating solution is prepared by admixing with distilled, deionized water 90.0 grams per liter of potassium citrate, 90.0 grams per liter of citric acid, 21.1 grams per liter of potassium hydroxide, 25.0 milliliters per liter of cobalt chelate (B), 12.0 grams per liter of 68 percent potassium gold cyanide, and 0.25 gram per liter of potassium cyanide. The resultant bath contains 8.2 grams per liter of gold (as metal) and 0.308 gram per liter of cobalt (also as the metal); it has a specific gravity of 15.0° Baume and a pH of 4.4.

A series of plating tests are carried out at 32.2° Centigrade and with an applied current density of 0.1 ampere per square decimeter, utilizing for each a brass coupon at the cathode. Operation of the bath is interrupted periodically, plating one of the coupons for 45.5 ampere-minutes in each segment of the cycle, following which the bath is replenished to bring the concentration of gold approximately to its initial value, and a new coupon is substituted. Plating is continued intermittently until one complete turnover of gold in the bath has been achieved. While the efficiency of the bath is seen to vary somewhat from run-to-run, an average value of approximately 55 milligrams per ampere minute is produced; the bath remains clear throughout the complete cycle and shows no sign of deterioration, and the deposits produced are of excellent quality.

Part B

The same series of tests are repeated, substituting for the plating solution utilized in Part A a bath having the same composition, but with the exception that the nickel chelate is employed in lieu of the cobalt product, and the amount of potassium hydroxide introduced is reduced to 12.15 grams per liter. The solution has a specific gravity of 13.8° Baume, a pH of 4.0, and a concentration of nickel (as metal) of 0.220 gram per liter.

Results entirely comparable to those achieved in Part A hereof are realized.

EXAMPLE FOUR

In a manner similar to that described in connection with Part A of Example Three, a ten gallon bath is prepared to contain 8.2 grams per liter of gold and 0.250 gram per liter of cobalt (both as the metals); the pH is 4.36 and the specific gravity is 15.0° Baume. Operation is carried out at 32.2° Centigrade under barrel plating conditions, using a barrel that is 3½ inches in diameter and 5½ inches long, containing 1800 cylindrical parts (one-half inch long and one-eighth inch in diameter) which present a total surface area of 413.28 square inches. The current applied is 5.0 amperes, the time of plating is 52 minutes, and the current density is 0.174 ampere per square decimeter.

Twenty of such loads of parts are plated, consuming all together 401.4 grams of gold, and hardness determinations are made at the completion of the tenth, fifteenth and twentieth runs. Measurements are made at three points; i.e., at the edge and at points 0.3 and 0.6 millimeter from the edge, on the outside surface. Depending upon the point at which the determination is made, the hardness values of the parts recovered after the tenth run range from 194 to 205; after the fifteenth run the values are 182 to 203, and after the twentieth run they are 176.5 to 191. Throughout the test, the bath remains clear, and there is no sign of precipitation or of other decomposition during electrolysis. Moreover, it is found that the same parts can be plated successively to achieve gold deposits as thick as two mils, without defoliation and while maintaining high levels of brightness; this is a most notable accomplishment that is attributed to the unique composition of the baths of the invention.

EXAMPLE FIVE

Part A

A plating solution is prepared by admixing 90.0 grams per liter of potassium citrate, 90.0 grams per liter of citric acid, 50 milliliters per liter of the nickel chelate, 12.0 grams per liter of 68 percent potassium gold cyanide, 0.25 gram per liter of potassium cyanide, and sufficient potassium hydroxide to bring the pH of the bath to a value of 4.1. The bath contains 8.2 grams per liter of gold and 0.500 gram per liter of nickel (both expressed as the metal), and it has a specific gravity of 13.4° Baume. Plating is effected in a high speed lab cell of the sort described in U.S. Pat. No. 4,102,770, using a nickel cathode and with the bath at a temperature of 54.4° Centigrade, maintaining a current density at the workpiece of 5.0 amperes per square decimeter in one instance, and a current density of 10.0 amperes per square decimeter in another. In the first run, the bath plates with an efficiency of 47 milligrams per ampere-minute; it produces a deposit which is bright and uniform, and has a hardness value of 208. At the higher current density level, efficiency is 46.6 milligrams per ampere minute, the deposit is semi-bright and uniform, and the hardenss value is 210 on the Knoop scale.

Part B

A bath is prepared by admixing 90.0 grams per liter of potassium citrate, 90.0 grams per liter of citric acid, 23.0 milliliters per liter of cobalt chelate (B), 120.0 grams per liter of potassium gold cyanide, 0.25 gram per liter of potassium cyanide, and sufficient potassium hydroxide to produce a pH in the solution of 4.4. The bath contains 8.2 grams per liter of gold and 0.230 gram per liter of cobalt, both expressed as the metal. Operation is carried out at the temperature and under the conditions described in connection with Part A hereof, again utilizing a nickel cathode. At a current density of 5.0 amperes per square decimeter the bath produces a bright and uniform deposit having a hardness of 250 on the Knoop scale, with an efficiency of 61 milligrams per ampere-minute. At 10 amperes per square decimeter the deposit is again bright and uniform, it has a hardness of 201, and efficiency is at a level of 69 milligrams per ampere-minute.

Part C

The cobalt content of the bath of Part B is adjusted to a concentration of 0.530 gram per liter, and the tests are repeated. The deposits are bright and uniform, having a hardness of 219 at a current density of 5 ASD, and a hardness of 209 at the 10 ASD level; efficiency values of 65 and 59 milligrams per ampere-minute are realized, respectively.

Part D

The cobalt content is further adjusted to 1.0 gram per liter, and again bright and uniform deposits are achieved. At 5 ASD, the Knoop hardness is 224 and the efficiency is 55 milligrams per ampere-minute; at 10 ASD, those values are 213 and 58, respectively.

Part E

The specific gravity of the bath is increased to 18° Baume (from the prevailing value of 12.9°), and the plating characteristics are again determined. Bright and uniform deposits are invariably achieved, with an efficiency of 65 and 64 at the 5 ASD and the 10 ASD levels, respectively. At the lower current density, the Knoop hardness value is 215, whereas it is 180 at the higher current density level.

EXAMPLE SIX

Part A

A solution is prepared from 22.5 grams per liter of potassium nitrate, 40.0 grams per liter of potassium citrate, 50.0 grams per liter of citric acid, 25.0 milliliters per liter of cobalt chelate, 6.0 grams per liter of potassium gold cyanide and 0.12 gram per liter of potassium cyanide. The resultant bath contains 4.1 gram per liter of gold and 0.25 gram per liter of cobalt (both as the metal); it has a pH of 3.5 and a specific gravity of 8.1° Baume. A series of Hull cell tests are run with the bath at 48.9° Centigrade, at three different currents levels (i.e., 0.5, 1.0 and 2.0 amperes) for periods of time sufficient to plate for one ampere-minute in each case (i.e., 2, 1, and 0.5 minute, respectively). At 0.5 ampere, the bath produces a bright range of 0–0.2+ ASD, with an efficiency of 46.2 milligrams per ampere-minute; at one ampere, the bright range is 0–0.4 ASD and the efficiency is 40.7; finally, at 2 amperes the bright range is extended to 0.8 ASD, and the efficiency is at a level of 39.3 milligrams per ampere-minute.

Part B

The runs of Part A hereof are repeated following addition of 25 milliliters per liter of the nickel chelate to the bath. The same ranges of brightness are achieved at the indicated levels of applied current; however, the efficiency values at 0.5, 1.0 and 2.0 amperes are 30.2, 26.0 and 17.7 milligrams per ampere-minute, respectively.

Part C

The runs of Part A are repeated following addition of sufficient amounts of potassium hydroxide to elevate the pH of the bath to 6.5, 7.6 and 9.1. In each case, the bath remains stable and shows no sign of deterioration; the brightness ranges are, however, considerably narrower than those that can be achieved with the more acidic bath.

EXAMPLE SEVEN

An indium chelate is prepared by adding 2.27 grams of indium sulfate, dissolved in 30 milliliters of distilled, deionized water, to a solution of 7.5 grams of GANTREZ S-95 in 50 milliliters of water, heated to about 65.5° Centigrade. Volume is brought to 100 milliliters with additional water, and the resultant clear solution is cooled; it contains 10 grams per liter of indium, as the metal.

Part A

Using the foregoing, a one liter plating bath is formulated by admixing, with 25 milliliters thereof, 22.5 grams of potassium nitrate, 40.0 grams of potassium citrate, 50.0 grams of citric acid, 6.0 grams of potassium gold cyanide, and 0.125 gram of potassium cyanide. The bath has a pH of 3.5 and a density of 8.4° Baume, and it contains 4.1 grams of gold and 0.25 gram of indium, as the metal.

A Hull cell test is performed at about 32° Centigrade for 2 minutes, with an applied current of 0.5 ampere and paddle agitation. The deposit produced is bright over a range of about 0 to 0.1 ASD, and plating efficiency is 51 milligrams per ampere-minute.

Part B

To the bath of Part A is added, per liter, 25.0 milliliters each of the previously described cobalt and nickel chelate solutions, to provide 0.25 gram of the respective metals therein. Hull cell tests are carried out for one ampere-minute with the bath under the same temperature and agitation conditions. Using applied currents of 2.0, 1.0 and 0.5 amperes, for periods of 0.5, 1.0 and 2.0 minutes, respectively, brightness ranges (in amperes per square decimeter) and efficiencies (in milligrams per ampere-minute) are achieved, as follows: 0–0.8+/17.0; 0–0.4+/24.0; and 0–0.2+/28.0.

Thus, it can be seen that the present invention provides a novel gold plating bath containing a metal hardener, which bath is stable and efficient over wide ranges of current density, pH values, and temperatures, and can be used to excellent advantage for rack, barrel, strip and other high speed applications. Gold deposits of high hardness are produced from the bath, which deposits contain relatively low concentrations of the codeposited metal, considering the levels of hardness achieved. The bath can be formulated readily and relatively economically, and is highly effective in resisting the effects of copper, lead and other metal contaminants. The invention also provides a novel and highly efficient method for electrodepositing hard, bright gold deposits over wide ranges of current densities, pH values and temperatures, which can readily be used in the various types of conventional electroplating apparatus and applications.

Having thus described the invention, what is claimed is:

1. A gold plating bath comprising, on a per liter basis, an aqueous solution of: an alkali metal gold cyanide in an amount providing about 1 to 41 grams of gold, calculated as the metal; free alkali metal cyanide in an amount effective to prevent precipitation of the metal values; an effective amount of an electrolyte ingredient; and about 0.05–10.0 grams of cobalt, nickel, indium, or a mixture thereof, in the form of a chelate with a hydrolyzed interpolymer of a methyl or ethyl vinyl ether and maleic anhydride, said bath having a pH value of about 3.0 to 13.0.

2. The bath of claim 1 wherein said electrolyte comprises a weak organic acid, and zero to an effective amount of a salt such acid.

3. The bath of claim 2 wherein said organic acid is citric.

4. The bath of claim 2 wherein said electrolyte comprises a mixture of said weak organic acid with an inorganic acid selected from the group consisting of acids that furnish the phosphate, nitrate and sulfate radicals.

5. The bath of claim 1 additionally including an alkali metal hydroxide for adjustment of said pH to said value.

6. The bath of claim 5 wherein said gold and alkali metal cyanides, and said hydroxide, are compounds of potassium.

7. The bath of claim 1 wherein said pH value is less than about 7.0, and wherein said bath has a specific gravity of about 4° to 30° Baume.

8. The bath of claim 7 wherein said pH value is about 4.0 to 6.0.

9. In a method of electroplating hard gold deposits upon a workpiece, the steps comprising: immersing a workpiece having an electrically conductive surface in the gold plating bath of claim 1, 3, 6, or 7; maintaining the temperature of said bath at about 20° to 75° Centrigrade; applying an electrical potential across said workpiece and an anode to provide a current density of about 0.1 to 165 amperes per square decimeter at said workpiece, and to thereby effect electrodeposition of gold in the desired thickness; and removing the electroplated workpiece from said bath.

10. The method of claim 9 wherein said temperature is about 35° to 50° Centigrade wherein said pH value is about 4.0 to 6.0, and wherein said current density has a maximum value of 75 amperes per square decimeter, said bath and/or said workpiece being agitated during electroplating.

11. The method of claim 10 wherein the temperature of said bath is above about 40° Centigrade and said current density is at least 5.0 amperes per square decimeter, said method constituting a high speed electroplating process.

* * * * *